United States Patent [19]

Takahashi et al.

[11] 4,397,699

[45] Aug. 9, 1983

[54] PROCESS FOR PRODUCING DEEP-DRAWING COLD ROLLED STEEL STRIP BY CONTINUOUS ANNEALING

[75] Inventors: Nobuyuki Takahashi; Yoshikuni Furuno, both of Kitakyusyu, Japan

[73] Assignee: Nippon Steel Corporation, Tokyo, Japan

[21] Appl. No.: 311,651

[22] Filed: Oct. 15, 1981

Related U.S. Application Data

[63] Continuation of Ser. No. 152,984, May 27, 1980, abandoned.

[51] Int. Cl.[3] ..... C21D 8/04

[52] U.S. Cl. ..... 148/12 C; 75/123 B; 148/36

[58] Field of Search ..... 148/12 C, 12 D, 36; 75/123 B

[56] References Cited

U.S. PATENT DOCUMENTS

| | | | |
|---|---|---|---|
| 3,725,143 | 4/1973 | Alworth et al. | 75/123 B |
| 3,912,549 | 10/1975 | Gondo et al. | 148/12 C |
| 3,950,191 | 4/1976 | Ito et al. | 148/36 |
| 3,988,173 | 10/1976 | Kawano | 148/12 C |
| 3,988,174 | 10/1976 | Kawano | 148/12 C |
| 4,001,052 | 1/1977 | Nakazato et al. | 75/123 B |
| 4,145,235 | 3/1979 | Gondo et al. | 148/12 C |
| 4,315,783 | 2/1982 | Akisue et al. | 148/12 C |

FOREIGN PATENT DOCUMENTS

| | | | |
|---|---|---|---|
| 51-41623 | 4/1976 | Japan | 148/12 D |
| 54-135616 | 10/1979 | Japan | 148/12 C |

*Primary Examiner*—Peter K. Skiff

*Attorney, Agent, or Firm*—Cushman, Darby & Cushman

[57] ABSTRACT

Process for producing a deep-drawing cold rolled steel strip by continuous annealing which comprises hot rolling a steel containing not more than 0.06% C, not more than 0.40% Mn, 0.0005 to 0.0020% B, the ratio of B/N being in the range from 0.5 to 1.5 and the balance being iron and unavoidable impurities, coiling the hot rolled steel strip at a temperature not higher than 680° C., cold rolling and continuously annealing the hot rolled strip.

The process produces super deep-drawing cold rolled steel strips without overageing treatment.

4 Claims, 1 Drawing Figure

PROCESS FOR PRODUCING DEEP-DRAWING COLD ROLLED STEEL STRIP BY CONTINUOUS ANNEALING

This is a continuation of application Ser. No. 152,984 filed May 27, 1980, abandoned.

BACKGROUND OF THE INVENTION

The present invention relates to a process for producing deep-drawing cold rolled steel strips by continuous annealing.

Cold rolled steel strips are very often used in the manufacture of cold-formed articles, such as press-formed automobile parts, and the strips are thus required to be soft and to have an excellent press-forming property.

Conventionally, aluminum-killed steels have been usually treated by a box annealing process for production of the deep-drawing cold rolled steel strips. However, the batch annealing process has the critical disadvantage that the process takes a long period of time to perform, and hence considerably lowers the production efficiency.

Therefore, much attention has been paid to new arts such as continuous annealing process, aiming at the production of deep-drawing cold rolled steel strips, and in recent years some continuous annealing processes have been in actual practice for production of cold rolled steel strips.

In the conventional continuous annealing arts, the steel is subjected to rapid heating, a short time of soaking and then rapid cooling. Therefore, when an Al-killed steel or an ordinary low carbon steel is treated by a conventional continuous annealing, the resultant steel has a small grain size and is hard, showing an inferior $\bar{r}$ value which is a parameter of the deep-drawability of steels as compared to that obtained by a box annealing process, hence failing to provide a deep-drawing cold rolled steel strip which can be satisfactorily press formed.

For eliminating the above disadvantages, it has been proposed that the steel strip after hot rolling is coiled at a high temperature not lower than 700° C. and subjected to cold rolling and then a continuous annealing process. However, the high-temperature coiling causes difficulties in acid pickling, and surface defects, such as ridging, which appear when the resultant cold rolled steel strip is worked, as well as deterioration of ductility due to formation of massive carbides.

Then for eliminating the disadvantages of the high temperature coiling, an art has been proposed for producing a deep-drawing cold rolled steel strip by a continuous annealing process without adopting a high-temperature coiling step, as disclosed in Japanese Patent Publication No. Sho 51-29696, according to which a soft cold rolled steel strip can be produced from an Al-killed steel containing boron by continuous annealing even with a low temperature coiling at about 650° C.

However, the B-containing Al-killed steel, as disclosed in the above mentioned Japanese Patent Publication, usually contains nitrogen in an amount as about 0.005 to 0.0065% and therefore, it is essential that the steel contains at least 0.0020% B. According to the disclosure of this prior art, the addition of boron has a subsidiary harmful effect to degrade the $\bar{r}$ value. This has been the critical problem of the conventional B-containing Al-killed steel.

Deep-drawing steel strips for press forming are required to have material qualities, in addition to a high $\bar{r}$ value, such that an excellent shape can be obtained by the press forming and that they have excellent stretchability. For these qualities they are required to have desirably a low yield point and a large elongation.

However, when the B-containing Al-killed steels are subjected to continuous annealing, they are often found to be hard and have a high yield point and a low elongation, although the steel can be softened to some degrees by the continuous annealing. Therefore, it has been found to be difficult to produce a satisfactory deep-drawing steel strip with consistency from the B-containing Al-killed steel by continuous annealing.

SUMMARY OF THE INVENTION

Therefore, the present inventors have made extensive studies and experiments for consistently producing cold rolled steel strips having excellent press formability by continuous annealing of B-containing Al-killed steels, and found that the reason why the $\bar{r}$ value of continuously annealed B-containing Al-killed steels is inferior is that in the prior art boron is added irrespective of the nitrogen content so that the softening effect of boron has not been fully developed, and that boron carbides which precipitate by the reaction between boron and carbon are harmful to the $\bar{r}$ value. This tendency becomes more apparent in steels containing nitrogen in an amount not less than 0.0050% or more and such steels show considerable variation in their yield point ranging from high to low values, and also in their elongation.

The present invention has been made in view of the above discoveries and the present invention is to provide a process for consistently producing a deep-drawing cold rolled steel strip by continuous annealing which comprises hot rolling B-containing Al-killed steel stock containing not more than 0.0040% N, preferably not more than 0.002% N, 0.0005 to 0.0020% B with the ratio of B/N being from 0.5 to 1.5, coiling the hot rolled steel strip at a temperature not higher than 680° C. so as to precipitate BN by reaction between the boron and the nitrogen thus prohibiting precipitation of boron carbides. The present invention has a technical advantage that the resultant steel provides satisfactory growth of grains inspite of the rapid heating and the short time of soaking inherent to continuous annealing.

DETAILED DESCRIPTION OF THE INVENTION

Figure 1:
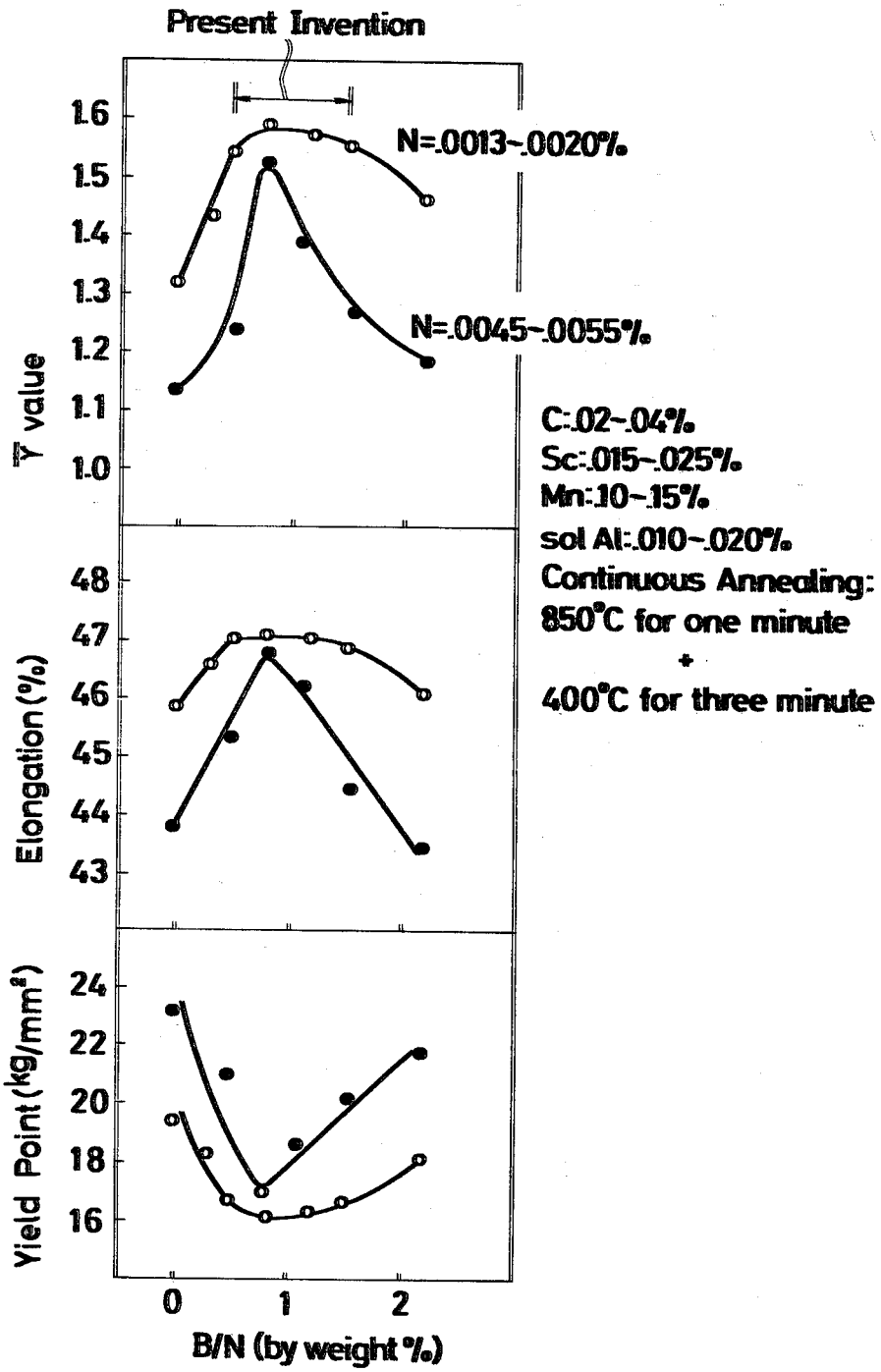
FIG. 1 shows effects of the ratio of B/N on the $\bar{r}$ value, the yield point and the elongation.

The present invention is applicable to a steel composition containing not more than 0.06% C, not more than 0.40% Mn, 0.005 to 0.05% acid soluble Al, not more than 0.0040%, preferably not more than 0.002% N, 0.0005 to 0.0020% B, with the ratio of B/N being from 0.5 to 1.5, the balance being iron and unavoidable impurities.

Carbon hardens the steel and the boron carbide precipitating from the reaction between boron and carbon lowers the $\bar{r}$ value. Therefore, the upper limit of the carbon content is set at 0.06%. When the carbon content is lowered to an amount not more than 0.01% by a vacuum degassing treatment etc. further improved deep-drawability can be obtained.

Manganese is essential for preventing brittleness fracture induced by sulfur during the hot rolling, but an excessive addition of manganese tends to lower the deep-drawability. Therefore, the upper limit of the manganese content is set at 0.40%.

Aluminum is required only for deoxidation of the steel applicable to the present invention, so at least 0.005% acid soluble-Al is necessary for performing a stable deoxidation treatment and for reducing the surface defects of the resultant steel strip. On the other hand, when an excessive amount of aluminum is added, the harmful boron carbide precipitation is caused becuase the precipitation of AlN predominates the precipitation of BN, so that the object of the present invention cannot be achieved. Therefore, the upper limit of the acid soluble-Al is set to 0.05%.

Nitrogen hardens the steel, lowers the deep-drawability, increases the yield point and lowers the elongation with considerable variation of the yield point and the elongation as above mentioned. Therefore, the nitrogen content should be maintained at 0.0040% or less, preferably at 0.002% or less, and should be further limited with respect to the ratio of B/N as described hereinafter.

Conventional steels normally contain about 0.005% N, and in order to lower the nitrogen content to the range defined in the present invention, it is necessary during the steel refining step in a converter to employ both the top blowing and the bottom blowing so as to lower the blown-off nitrogen content, or to prevent the pick-up of nitrogen from the air during the pouring of the heat.

Boron is one of the most important elements for the steel applicable to the present invention. In order to precipitate BN with reaction between boron and nitrogen in in the steel, and to prevent the boron carbide formation at the stage when the steel strip is coiled as a hot coil after the hot rolling, 0.0005 to 0.0020% B within the B/N range of from 0.5 to 1.5 should be added.

The boron range from 0.0005 to 0.0020% has been defined in view of the fact that even when the nitrogen content is lowerd as much as possible during the steel preparation, the resultant steel contains about 0.0008% nitrogen, and in order to react with this lowest limit of the nitrogen content and to soften the steel, at least 0.0005% boron is required. On the other hand, as the boron content increases the deep-drawability lowers, and thus the boron content should be limited to the upper limit of 0.0020%.

The lower limit 0.5 of the ratio of B/N has been defined from the fact that at a ratio less than 0.5 a fine AlN precipitation is caused, resulting in excessive refinement of grains after the cold rolling and annealing, hence an increased yield point, a lowered elongation and a lowered deep-drawability. On the other hand, when the ratio exceeds 1.5, the excessive boron reacts with the carbon to precipitate boron carbide which lowers the deep-drawability, and at the same time the grain size after the cold rolling and annealing becomes excessively fine, thus causing the hardening of the steel. The most desirable B/N ratio is from 0.8 to 1.0.

The effects of the B/N ratio on the $\bar{r}$ value, the yield point and the elongation of the steel after the continuous annealing are shown in FIG. 1. The steels used for the test contained 0.02 to 0.04% C, 0.0015 to 0.025% Si, 0.10 to 0.15% Mn, 0.010 to 0.020% acid soluble Al and contained different nitrogen contents in a range of from 0.0013 to 0.0020% which is within the scope of the present invention and in another range of from 0.0045 to 0.005% which is outside the scope of the present invention, and the steels were hot rolled at a temperature not lower than the $Ar_3$ point, coiled at a temperature between 600° and 650° C., cold rolled, then subjected to continuous annealing at 850° C. for one minute, and further subjected to an overageing treatment at 400° C. for three minutes.

As clearly understood from the results shown in FIG. 1, the steels containing a lowered nitrogen content and containing boron within the B/N range of from 0.5 to 1.5 according to the present invention show a high $\bar{r}$ value, a large elongation value, and a low yield point value. It should be further noted that the tendencies of these properties are flat. This indicates that these properties can be obtained with a high degree of consistency. On the other hand, the steels containing an excessive nitrogen content which is outside the scope of the present invention show a sharp variation in the above properties and are inferior with respect to these properties in spite of their B/N ratio being within the range of from 0.5 to 1.5.

As illustrated above, deep-drawing strips having excellent deep-drawability, sharp fixability and stretchability can be produced with a high degree of consistency according to the present invention.

Phosphorus, sulfur, silicon and so on which unavoidably come into the steel as impurity should be preferably lowered as much as possible.

According to the present invention molten steel having the above defined composition is made into steel slabs which are then subjected to finishing hot rolling and coiled at a temperature not higher than 680° C.

The steel slab may be prepared either by a continuous casting process or an ingot-making process, and also the steel slab may be hot rolled as a hot slab or a cold slab. Regarding the heating temperature for the hot rolling, a lower temperature is more desirable for the purpose of promoting the BN precipitation.

The finishing hot rolling temperature is preferably not lower than the $Ar_3$ point for the purpose of obtaining the desired deep-drawability. If the coiling temperature is excessively high, a large amount of boron carbide is formed in the hot rolled steel strip, thus causing deterioration of the deep-drawability. Therefore, the coiling temperature should be not higher than 680° C.

The hot rolled coil thus obtained is subjected to acid pickling and cold rolling with a cold reduction ranging from 60 to 90% ordinarily, then subjected to continuous annealing including overageing treatment, and further, if necessary, subjected to temper rolling. It should be noted that the conditions of these steps are not specifically limited. It is desirable, however, that the annealing is done not lower than the recrystallization temperature, but not higher than the $Ar_3$ point, and for obtaining excellent deep-drawability in particular, an annealing temperature not lower than 800° C. is preferable.

DESCRIPTION OF PREFERRED EMBODIMENT

The present invention will be better understood from the following embodiments.

EXAMPLE 1

The steel having a chemical composition shown in Table 1 was prepared in a converter, continuously cast into slabs, which were hot rolled into hot coils of 4.0 mm in thickness under the conditions shown in Table 1.

TABLE 1

| | Designation | Chemical Composition (wt. %) | | | | | | | | | Hot Rolling Temperature (°C.) | | |
|---|---|---|---|---|---|---|---|---|---|---|---|---|---|
| | | C | Si | Mn | P | S | sol. Al | N | B | B/N | Heating Temp. | Finishing Temp. | Coiling Temp. |
| Present Invention | A | 0.041 | 0.022 | 0.21 | 0.013 | 0.010 | 0.020 | 0.0021 | 0.0019 | 0.90 | 1250 | 885 | 630 |
| | B | 0.045 | 0.023 | 0.23 | 0.010 | 0.009 | 0.035 | 0.0014 | 0.0010 | 0.71 | 1250 | 890 | 650 |
| | C | 0.043 | 0.021 | 0.20 | 0.012 | 0.012 | 0.027 | 0.0030 | 0.0020 | 0.67 | 1250 | 895 | 620 |
| | D | 0.022 | 0.025 | 0.22 | 0.013 | 0.011 | 0.031 | 0.0010 | 0.0008 | 0.80 | 1250 | 895 | 635 |
| Comparative Steels | E | 0.048 | 0.024 | 0.25 | 0.014 | 0.010 | 0.030 | 0.0040 | — | — | 1250 | 880 | 620 |
| | F | 0.044 | 0.021 | 0.26 | 0.012 | 0.012 | 0.083 | 0.0034 | 0.0058 | 1.71 | 1250 | 890 | 620 |
| | G | 0.045 | 0.018 | 0.29 | 0.013 | 0.011 | 0.033 | 0.0066 | 0.0029 | 0.44 | 1250 | 880 | 645 |

acid-pickled, cold rolled into 0.8 mm thickness, subjected to recrystallization annealing at 750° C. for one minute, subjected to overageing treatment at 400° C. for three minutes, and temper rolled with 1.0% reduction. The mechanical properties of the steel strips thus obtained are shown in Table 2.

As clearly understood from the results shown in Table 2, the steels A, B, C and D within the scope of the present invention show a higher $\bar{r}$ value and softer than the steels E, F and G and thus provide a better deep-drawing steel sheet.

TABLE 2

| Designation | Present Invention | | | | Comparative Steels | | |
|---|---|---|---|---|---|---|---|
| | A | B | C | D | E | F | G |
| Y.P. (kg/mm$^2$) | 19.6 | 19.4 | 20.7 | 18.5 | 24.8 | 24.9 | 23.5 |
| T.S. (kg/mm$^2$) | 32.0 | 31.8 | 32.4 | 31.4 | 34.0 | 33.8 | 34.6 |
| Elongation (%) | 46.5 | 46.5 | 45.5 | 48.0 | 43.0 | 43.5 | 45.0 |
| $\bar{r}$ Value | 1.52 | 1.56 | 1.44 | 1.63 | 1.26 | 1.30 | 1.24 |

TABLE 3

| | Designation | Chemical Composition (wt. %) | | | | | | | | | Hot Rolling Temperature (°C.) | | |
|---|---|---|---|---|---|---|---|---|---|---|---|---|---|
| | | C | Si | Mn | P | S | sol. Al | N | B | B/N | Heating Temp. | Finishing Temp. | Coiling Temp. |
| Present Invention | H | 0.004 | 0.026 | 0.22 | 0.013 | 0.010 | 0.033 | 0.0029 | 0.0017 | 0.59 | 1250 | 895 | 630 |
| | I | 0.009 | 0.024 | 0.30 | 0.014 | 0.012 | 0.042 | 0.0036 | 0.0020 | 0.56 | 1250 | 900 | 620 |
| | J | 0.003 | 0.023 | 0.12 | 0.012 | 0.010 | 0.022 | 0.0011 | 0.0009 | 0.81 | 1250 | 910 | 640 |
| | K | 0.005 | 0.020 | 0.20 | 0.013 | 0.011 | 0.035 | 0.0020 | 0.0018 | 0.90 | 1250 | 900 | 635 |
| Comparative Steels | L | 0.008 | 0.025 | 0.27 | 0.013 | 0.013 | 0.020 | 0.0042 | — | — | 1250 | 895 | 610 |
| | M | 0.005 | 0.026 | 0.21 | 0.014 | 0.010 | 0.077 | 0.0062 | 0.0028 | 0.46 | 1250 | 900 | 620 |

EXAMPLE 2

An extremely low-carbon steel having a chemical composition shown in Table 3 was continuously cast into slabs, which were hot rolled at various temperatures shown in Table 3 into 4.0 mm thickness, acid-pickled, cold rolled into 0.8 mm thickness, soaked at 850° C. for one minute, cooled in the air, and temper rolled with 0.8% reduction. The mechanical properties of the steel sheets thus obtained are shown in Table 4.

As clearly shown by the above results, the cold rolled steel strips obtained according to the present invention show a very high $\bar{r}$ value not lower than 1.9 and much better deep drawability and stretchability as compared with the comparative steels. Also it should be noted that the steel strips obtained by the present invention show very excellent elongation as high as 50% or more without an overageing treatment.

As clearly shown by the foregoing examples, the B-containing super low carbon Al-killed steel produced according to the method of the present invention provides very excellent deep-drawability and stretchability with the low-temperature coiling but without the overageing treatment. Thus the present invention has great industrial advantage that super deep-drawing cold rolled steel strip can be produced by low temperature coiling and without the overageing treatment.

The present invention has a further advantage that the cold rolled steel sheet produced by the method of the present invention may be surface-coated with zinc, tin, chromium, aluminum etc., and thus surface treated steel sheets having excellent deep-drawability can be produced by continuous annealing.

TABLE 4

| Designation | Present Invention | | | | Comparative Steels | |
|---|---|---|---|---|---|---|
| | H | I | J | K | L | M |
| Y.P. (kg/mm$^2$) | 16.3 | 16.4 | 15.2 | 15.7 | 20.6 | 19.0 |
| T.S. (kg/mm$^2$) | 30.6 | 30.8 | 29.8 | 30.7 | 33.0 | 32.7 |
| Elongation (%) | 53 | 53 | 54 | 53 | 45 | 47 |
| $\bar{r}$ value | 1.94 | 1.90 | 2.05 | 2.00 | 1.56 | 1.64 |

What is claimed is:

1. A process for consistently producing a deep-drawing cold rolled steel strip by continuous annealing, said process comprising the successive steps of:

(1) hot rolling a steel containing:
not more than 0.06% C,
0.12 to 0.40% Mn,
0.005 to 0.05% acid soluble Al,
not more than 0.0040% N,
0.0005% to 0.0019% B
wherein the ratio of B to N is in the range of from 0.56 to 0.90
balance iron and unavoidable impurities;

(2) coiling the hot rolled steel strip from step (1) at a temperature not greater than 680° C.,
thereby precipitating BN by reaction between the boron and nitrogen thereby preventing precipitation of boron carbides;

(3) cold rolling the coiled roll of step (2); and thereafter (4) continuously annealing the cold rolled strip of step (3)

thereby developing large crystal grains in the steel, providing a high $\bar{r}$ value not lower than 1.9, a substantial elongation value and a low yield point value to the resulting cold rolled steep strip.

2. A process according to claim 1, in which the steel contains not more than 0.0019%B, the ratio of B/N being in the range of from 0.8 to 0.9.

3. A process according to claim 1, in which the steel contains not more than 0.009% C.

4. A process according to claim 1, in which the steel contains not more than 0.009% C and 0.12 to 0.30% Mn.

* * * * *